US005078286A

United States Patent [19]

Hashimoto

[11] Patent Number: 5,078,286

[45] Date of Patent: Jan. 7, 1992

[54] CONTAINER FOR A SOFT DRINK

[75] Inventor: Kentaro Hashimoto, Tokyo, Japan

[73] Assignee: Tokyo Glass Seiki Kabushiki Kaisha, Tokyo, Japan

[21] Appl. No.: 634,505

[22] Filed: Dec. 27, 1990

[51] Int. Cl.[5] ..... B65D 23/00

[52] U.S. Cl. ..... 215/1 A; 215/229; 215/253; 220/710

[58] Field of Search ..... 215/1 A, 30, 229, 253; 220/90.2, 90.4, 90.6, DIG. 7; 222/527, 530, 464, 541, 538

[56] References Cited

U.S. PATENT DOCUMENTS

| | | | |
|---|---|---|---|
| 3,349,987 | 10/1967 | Weitzner | 229/103.1 |
| 3,462,061 | 8/1969 | Shore | 229/103.1 |
| 3,765,574 | 10/1973 | Urquiza | 222/465.1 |
| 3,774,804 | 11/1973 | Henning | 229/103.1 |
| 4,586,625 | 5/1986 | Garrett | 220/90.4 |
| 4,607,755 | 8/1986 | Andreozzi | 220/90.4 |
| 4,759,475 | 7/1988 | Munthe | 222/464 |
| 4,811,860 | 3/1989 | Sorenson et al. | 215/1 A |
| 4,921,147 | 5/1990 | Poirier | 222/527 |
| 5,005,717 | 4/1991 | Oilar | 220/90.2 |

FOREIGN PATENT DOCUMENTS

| | | | |
|---|---|---|---|
| 3023751 | 1/1982 | Fed. Rep. of Germany | 215/229 |

*Primary Examiner*—Stephen Marcus
*Assistant Examiner*—Christopher McDonald
*Attorney, Agent, or Firm*—Oblon, Spivak, McClelland, Maier & Neustadt

[57] ABSTRACT

A fluid container made of thin, soft synthetic resin includes a substantially cube-shaped body with at least one longitudinal cutout portion in a corner portion of the body, a straw member coextensively disposed in the cutout portion and which has one end thereof in communication with the interior of the container body, and a fluid infusion nozzle protruding from the container, the fluid infusion nozzle being retractably connected to the container body for being retracted after fluid infusion through the nozzle. The straw member also includes a bellows formed in an intermediate portion thereof and a reinforcement wall which interconnects the straw with the container.

3 Claims, 3 Drawing Sheets

CONTAINER FOR A SOFT DRINK

BACKGROUND OF THE INVENTION

1. Field of the Invention

This invention relates to a soft-synthetic resin contain for sealing fruit juice or milk or other dairy or other liquids, and in particular relates to like blow-molded containers.

2Discussion of the Background

Conventionally, a blow molding machine is used to manufacture this category of containers. In a blow molding machine, a synthetic resin tubular blank while continuously being supplied is introduced between a pair of molds. With molds closed, the blank is blown by means of a hollow conduit placed in the blank to produce a product. When a nozzle for infusing a fluid into the container is desired to be provided for containers of this type, the nozzle has to be formed in the form of a projection for the reasons of blow manufacturing and usage of the infusion nozzle itself. The nozzles will obstruct transportation and/or display of the containers because of their projecting form. When drinking straws are desired to be offered along with containers in other cases, they may conventionally be provided separately or fixed to containers. The former will be a burden with regard to sales operation. The latter requires an extra space and costs more.

SUMMARY OF THE INVENTION

One object of this invention is to provide fluid containers which can be neatly nested for transportation and marketing display and have a durable, good-looking appearance. Another object is to provide a container having a drinking straw attached thereto and still presenting a generally cube-shaped container, permitting neat nesting on the other. According to still another feature of the invention, the attached straw can be bent in the horizontal direction for the conveniences of drinking from the container.

According to a feature of the invention, a cubical container is provided which has a fluid infusion nozzle projecting from the container surface and has an arrangement permitting the nozzle to be pushed into the container after operation of fluid infusion, whereby the fluid-filled container has a generally cube-shaped contour or configuration facilitating nesting, transportation and marketing display.

According to another feature of the invention, a container is provided with a longitudinal cutout portion in the outer surface, and a straw member is coextensively disposed in said cutout portion with one end communicating to the interior of the container, whereby a generally cube-shaped configuration of the container remains unchanged and the separate provision of drinking straws can be dispensed with.

According to still another object of the invention, the straw member has a bellows in the intermediate portion thereof, permitting the straw member to be horizontally bent in a wide angular position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

FIG. 9 is a sectional view showing an infusion nozzle before it is pulled in.

Figure 1:
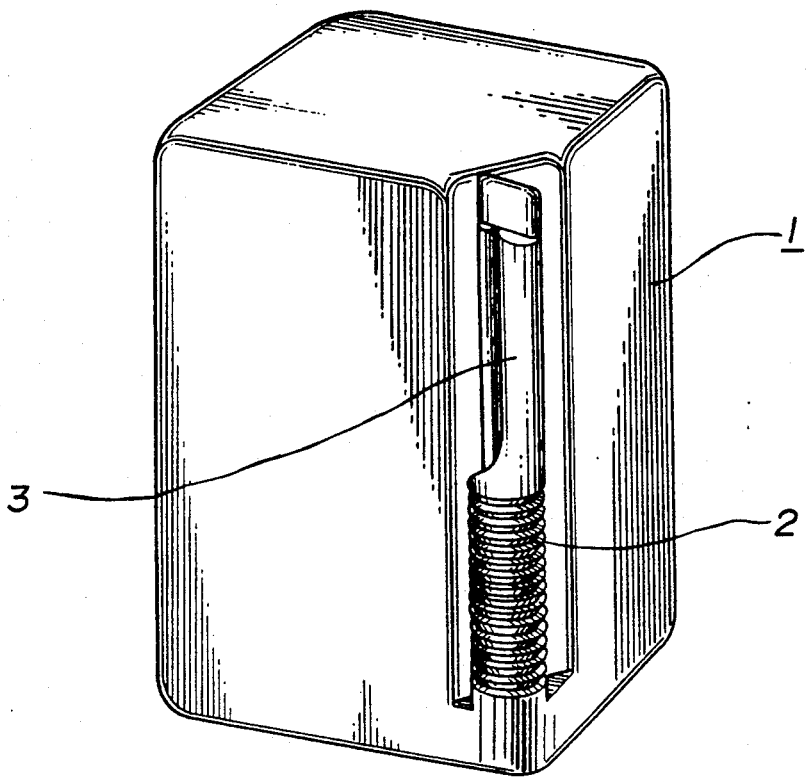
FIG. 1 is a perspective view.
Figure 2:
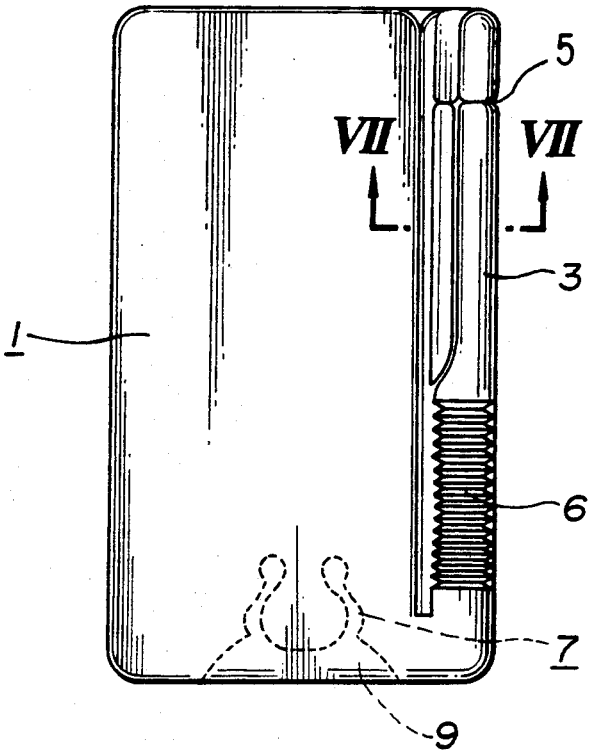
FIG. 2 is a front view.
Figure 3:
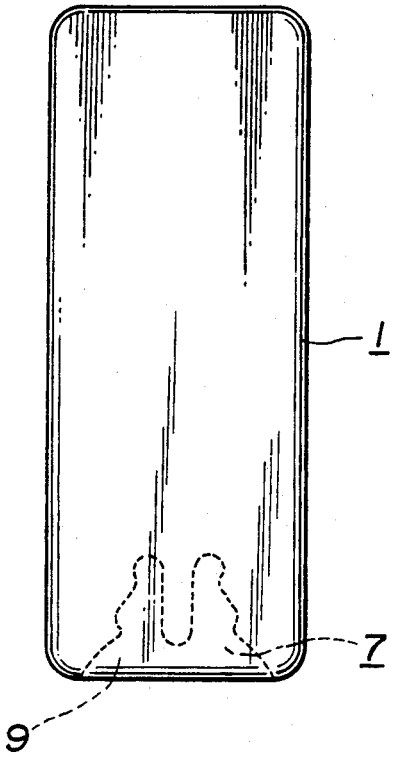
FIG. 3 is a side view.
Figure 4:
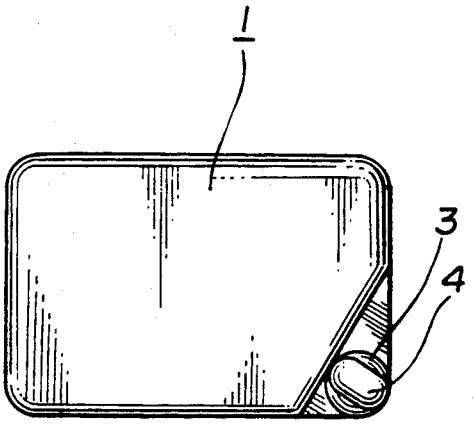
FIG. 4 is a plan view.
Figure 5:
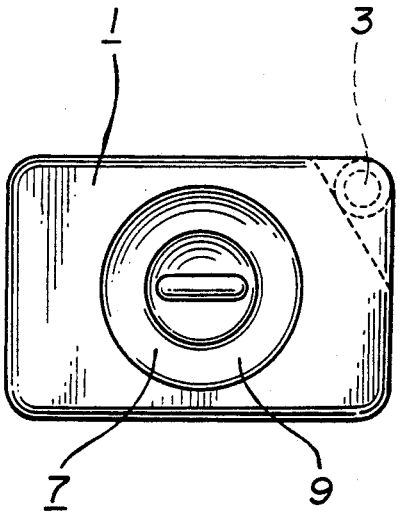
FIG. 5 is a bottom view.
Figure 6:
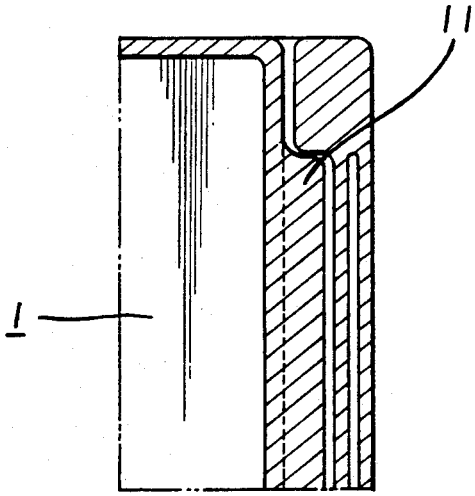
FIG. 6 is a partial sectional view showing a straw member portion.

Referring to the attached drawings, there is shown a container body 1 made of a relatively soft synthetic resin. The container body has a longitudinal cutout portion 2 in one corner. A straw member 3 is disposed in the cutout portion 2. It is critical that the container body 1 with the straw member attached thereto has a generally elongate cube-shaped configuration.

The straw member has an upper end closed in the form of a cap 4 which is formed so as to have a small thickness portion 5 joining the cap to the intermediate portion of the straw member, so that the cap 4 can be manually twisted off at the portion 5. The lower portion of the straw member is formed with a bellows 6 permitting free bending in the horizontal direction. The lowest end of the straw member 3 is formed to be one-piece with the container body 1 for communication with the interior.

Figure 7:
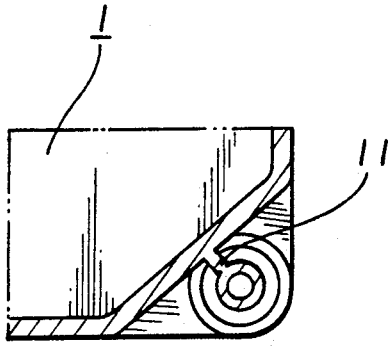
FIG. 7 is a cross sectional view along line VII—VII of FIG. 2.

The container body is provided with a fluid infusion nozzle 7 protruding centrally from the bottom in the downward direction. The distal end of the infusion nozzle 7 is formed to have a conduct 8 (which directly results from blow molding). The conduct 8 is diametrically gradually enlarged at 9 with a relative thin wall and thereby connected to the wall of the container wall. The enlargement 9 has a plurality of circumferential ribs 10. The straw member 3 has a reinforcement wall 11 connecting to the container body 1 and as shown in FIG. 7, having a thinned portion adjacent the circumference of the straw member. This permits the straw member 3 to be broken off from the container body 1.

Figure 8:
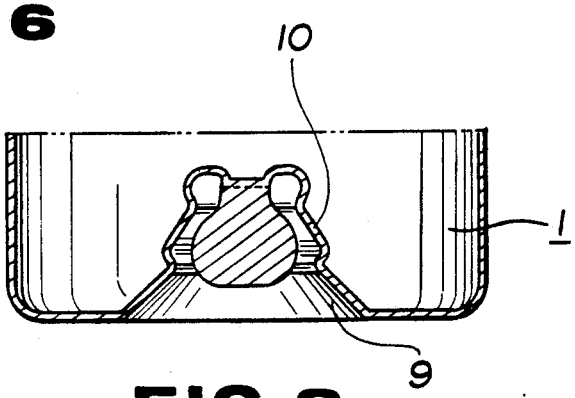
FIG. 8 is a sectional view showing an infusion nozzle in its pulled-in position.
Figure 9:
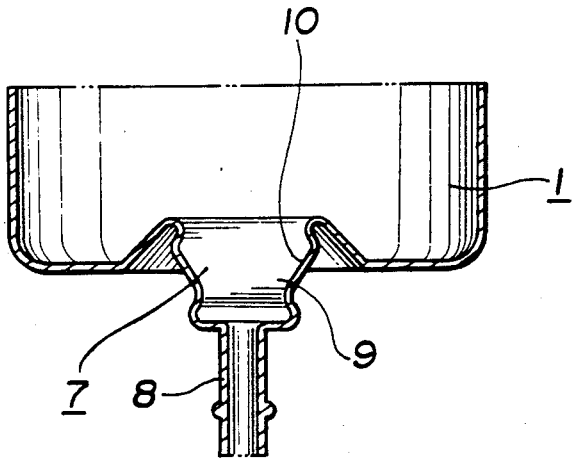

Fluid like milk or fruit juice is infused by means of not-shown apparatus, through the infusion nozzle 8 into the container interior. After completion of the infusion the nozzle 8 is compressed into the interior of container. Specifically, as in FIG. 8, the nozzle may be pushed into the interior of container body 1 by a suitable means. The circumferential ribs 10 in the enlargement portion 9 facilitate pushing operation into the container. After the nozzle 7 has been pushed in the container to expel the content of the container, the volumetric change had previously been believed by the inventor to present an appreciable problem, but no such problem was subsequently found to take place. No deformation of the configuration was found after several experiments were made with a container 1 of 65×35×130 mms, with a volume of 250 cc with LDPE wall thickness 0.6 mm.

Containers according to the present invention will present a general cube-shaped contour or configuration without any outstanding projection so that they can be nested or layered for facilitating transportation and marketing display with smaller dead spaces created than those by cylindrical containers as nested.

The container of the present invention does not necessitate the separate provision of drinking straws. The straw member 3 may be separated from the reinforcement wall 11 of the container body 1 in order to drink from the container. The bellows 6 of the member may facilitate horizontal bending of the straw member. The reinforcement wall 11 connecting the straw member to the container body 1 serves to present the straw member from moving undesirably during transportation of container. The cap 4 is twisted off from the straw member 4 to open the latter.

What is claimed is:

1. A fluid container made of a synthetic resin, comprising:

a substantially cube-shaped body with at least one longitudinal cutout portion in a corner portion of said body, a straw member coextensively disposed in said cutout portion and which has one end in communication with the interior of the container body, and a fluid infusion nozzle protruding from the container, said fluid infusion nozzle being retractably connected to the container body for being retracted after fluid infusion through the nozzle.

2. The fluid container defined in claim 1 wherein said straw member comprises a bellows formed in an intermediate portion thereof.

3. The fluid container defined in claim 1, which comprises a reinforcement wall which interconnects said straw with said container.

* * * * *